US005908512A

United States Patent [19]

Shirahata et al.

[11] Patent Number: 5,908,512

[45] Date of Patent: Jun. 1, 1999

[54] HIGHLY DURABLE SURFACE-CONDITIONING AGENT

[75] Inventors: Seiichiro Shirahata, Toyonaka, Japan; Mitsuo Shinomiya, Rocky River, Ohio; Tamotsu Sobata, Ibaraki, Japan

[73] Assignee: Nippon Paint Co., Ltd., Osaka, Japan

[21] Appl. No.: 08/955,597

[22] Filed: Oct. 22, 1997

[51] Int. Cl.[6] ..... C23C 22/80

[52] U.S. Cl. ..... 148/254; 106/14.12; 148/253

[58] Field of Search ..... 106/14.12; 148/253, 148/254

[56] References Cited

U.S. PATENT DOCUMENTS

| | | | |
|---|---|---|---|
| 4,152,176 | 5/1979 | Guhde | 148/254 |
| 4,497,667 | 2/1985 | Vashi | 148/254 |
| 4,770,717 | 9/1988 | Griffith et al. | 148/271 |
| 5,494,504 | 2/1996 | Wright | 148/254 |
| 5,776,265 | 7/1998 | Kramer et al. | 148/254 |

FOREIGN PATENT DOCUMENTS

| | | | |
|---|---|---|---|
| 363200 | 4/1990 | European Pat. Off. | 148/253 |
| 9-249978 | 9/1997 | Japan | C23C 22/80 |
| 794717 | 5/1958 | United Kingdom | 148/254 |

OTHER PUBLICATIONS

Chemical Abstract No. 100:194075, abstract of Czech. Patent No. 202442, Mar. 1983.

Chemical Abstract No. 115:118396, abstract of Czech. Patent No. 265567, Dec. 1989.

*Primary Examiner*—Anthony J. Green

*Attorney, Agent, or Firm*—Pollock, Vande, Sande & Amernick

[57] ABSTRACT

The present invention provides a highly durable surface-conditioning agent for use in a pretreatment step for a phosphate coating treatment of metallic materials, which is an aqueous solution comprising 1 to 50 ppm of titanium ion, 50 to 1,000 ppm or phosphate ion, 50 to 400 ppm of tripolyphosphate ion and 20 to 1,500 ppm of carbonate ion, with a tripolyphosphate ion/titanium ion weight ratio of 10 to 100, and having a pH of 8.5 to 10.0.

1 Claim, No Drawings

HIGHLY DURABLE SURFACE-CONDITIONING AGENT

FIELD OF THE INVENTION

The present invention relates to a highly durable surface-conditioning agent for use in a pretreatment for a phosphate coating treatment of a metallic material.

BACKGROUND ART

Automotive bodies, household electric appliances and the like are produced by molding metallic materials, such as steel sheets and galvanized steel sheets, into metallic moldings, followed by coating and assembling, etc. The coating of such metallic moldings includes various steps, namely the steps of degreasing, surface conditioning, chemical conversion treatment, electrodeposition coating, among others.

The surface-conditioning treatment is a treatment required for enabling, in the next phosphate coating treatment step, rapid formation of uniform and high-density coatings consisting of phosphate salt crystals all over the metal surface. It generally comprises immersing metallic moldings in a surface-conditioning bath to thereby cause formation of phosphate crystal nuclei on the metal surface.

The surface-conditioning ability of a surface-conditioning agent results from the titanium phosphate colloid contained in the surface-conditioning agent. The titanium phosphate colloid by nature tends to undergo dissolution or aggregation with the lapse of time, hence be progressively deteriorated.

In the case of surface-conditioning agents, techniques have been investigated for stabilizing the titanium phosphate colloid by pII adjustment and other means to thereby avoid the degradation of colloidal character or the unsatisfactory surface conditioning resulting from the colloid becoming a suspension.

Japanese Kokai Publication Hei-02-83202 discloses a method for preparing activated titanium phosphate having stable surface conditioning ability and suited for zinc phosphating. Said method comprises preparing activated titanium phosphate for zinc phosphating from a titanium (IV) compound and at least one member selected from the group consisting of an orthophosphoric acid compound, a polyphosphoric acid compound and a metaphosphoric acid compound and can give a surface-conditioning agent having stable surface-conditioning ability as compared with the prior art surface-conditioning agents showing greatly varying surface-conditioning ability among batches even when prepared under certain specified reaction conditions.

The surface-conditioning agent obtained by said method, however, still has drawbacks. For instance, the pH control in surface-conditioning baths is difficult, hence it is difficult to obtain a stable titanium phosphate colloid, and this is disadvantageous in particular in dipping treatment which requires a stable surface-conditioning agent in large quantities over a long period of time.

Japanese Kokoku Publication Sho-58-55229 discloses a surface-conditioning agent for zinc phosphating which comprises titanium ion, phosphate ion, pyrophosphate ion and carbonate ion. This surface-conditioning agent is characterized in that the pH is prevented from decreasing by the addition of a carbonate ion-providing carbonic acid compound and the titanium phosphate colloid is stabilized by the addition of pyrophosphate ion and that the surface-conditioning ability can be stably exhibited over a long period of time. Another feature is that said composition is advantageous in dipping treatment in which a, particular requirement is long-period stability, since the pH can easily be controlled by addition of a carbonic acid compound.

However, the pyrophosphate ion used there is not sufficient in its property as a metal chelating agent capable of stabilizing titanium phosphate colloid and said surface-conditioning agent cannot be said to be a surface-conditioning agent having good durability.

SUMMARY OF THE INVENTION

In view of the state of the art mentioned above, it is a primary object of the present invention to provide a surface-conditioning agent having excellent surface-conditioning ability and high durability.

The highly durable surface-conditioning agent of the present invention is a highly durable surface-conditioning agent for use in a pretreatment step for a phosphate coating treatment of metallic materials, which is an aqueous solution comprising 1 to 50 ppm of titanium ion, 50 to 1,000 ppm of phosphate ion, 50 to 400 ppm of tripolyphosphate ion and 20 to 1,500 ppm of carbonate ion, with a tripolyphosphate ion/titanium ion weight ratio of 10 to 100, and having a pH of 8.5 to 10.0.

DETAILED DESCRIPTION OF THE INVENTION

The highly durable surface-conditioning agent of the present invention causes titanium phosphate colloid to adhere to the surface of a metallic material such as iron or zinc and thereby promotes, in the next phosphate coating treatment, the formation of chemical conversion coatings with the aid of said colloid as crystal nuclei, leading to formation of good chemical conversion coatings.

The highly durable surface-conditioning agent of the present invention comprises 1 to 50 ppm of titanium ion, 50 to 1,000 ppm of phosphate ion, 50 to 400 ppm of tripolyphosphate ion and 20 to 1,500 ppm of carbonate ion.

When the concentration of said titanium ion is less than 1 ppm, the colloid to serve as crystal nuclei is insufficient. At concentrations exceeding 50 ppm, no extra effect than the desired effect can be obtained, hence they are uneconomical. Thus, the above range is critical.

The source of said titanium ion is not limited to any particular species but includes, among others, titanium sulfate and titanium oxide.

When the concentration of said phosphate ion is less than 50 ppm, the colloid to serve as crystal nuclei is insufficient. At concentrations exceeding 1,000 ppm, no extra effect than the desired effect can be obtained, hence they are uneconomical. Thus, the above range is critical.

The source of said phosphate ion is not limited to any particular species but includes, among others, phosphoric acid; alkali metal dihydrogenphosphates such as sodium dihydrogenphosphate; ammonium dihydrogenphosphate; dialkali metal hydrogenphosphates such as disodium hydrogenphosphate: diammonium hydrogenphosphate; trialkali metal phosphates such as trisodium phosphate; and triammonium phosphates.

At concentrations below 50 ppm, said tripolyphosphate ion as a metal chelating agent cannot stabilize the colloid effectively, hence fine chemical conversion coatings cannot be formed in the next phosphate coating treatment. At concentrations exceeding 400 ppm, said ion reacts with the metallic material surface to form tripolyphosphate compounds, inhibiting the formation of chemical conversion coatings. The above range is thus critical.

The source of said tripolyphosphate ion is not limited to any particular species but includes, among others, alkali metal salts of tripolyphosphoric acid such as sodium tripolyphosphate, etc.

When the concentration of said carbonate ion is less than 20 ppm, no substantial buffering effect can be produced and the pH is allowed to lower, and tripolyphosphate compounds are formed by the reaction of said tripolyphosphate ion with the metallic material surface, whereby the formation of chemical conversion coatings is inhibited. At concentrations exceeding 1,500 ppm, the formation of chemical conversion coatings is inhibited. The above range is thus critical.

As a result of adjustment of the carbonate ion concentration to the range mentioned above, the highly durable surface-conditioning agent of the present invention is maintained at pH 8.5 to 10.0 and the colloid is stabilized.

The source of the bicarbonate ion is not limited to any particular species but includes, among others, carbonic acid; alkali metal acid carbonate such as sodium acid carbonate; and ammonium acid carbonate.

The source of said carbonate ion is not limited to any particular species but includes, among others, carbonic acid; alkali metal carbonates such as sodium carbonate; and ammonium carbonate.

In accordance with the present invention, the (tripolyphosphate ion)/(titanium ion) weight ratio is within the range of 10 to 100. When said ratio is less than 10, the colloid is unstable and tends to aggregate and the resulting surface-conditioning agent loses durability. When said ratio exceeds 100, the colloid is dissolved and the resulting surface-conditioning agent lacks durability. The above range is thus critical. A preferred range is 20 to 40.

The level of addition of said tripolyphosphate ion can suitably be selected depending on the hardness of water. When, for instance, the hardness of water is high, said tripolyphosphate ion chelates metal ions contained in water and therefore its proportion of said tripolyphosphate ion which can effectively chelate the colloid decreases, hence the level of addition thereof should preferably be increased.

The highly durable surface-conditioning agent of the present invention has a pH of 8.5 to 10.0.

At a pH below 8.5, said tripolyphosphate ion will react with the metallic material surface to form a tripolyphosphate compound, inhibiting the formation of chemical conversion coatings. At a pH above 10.0, the colloid tends to dissolve, thus becomes unstable. A preferred pH range is 9.0 to 9.5.

In the practice of the present invention, sodium pyrophosphate may additionally be used for further stabilization of the colloid and for forming fine chemical conversion coatings in the next phosphate coating treatment.

In the practice of the present invention, at least one member selected from the group consisting of sodium carbonate and sodium bicarbonate may additionally be added for the purpose of obtaining a more marked buffering effect.

The present invention, which has the above constitution, enables highly durable surface conditioning as compared with the conventional surface-conditioning agents, providing an even, uniform and dense chemical conversion coating in the next phosphate coating treatment step.

BEST MODE FOR CARRYING OUT THE INVENTION

The following reference examples and Examples illustrate the present invention in further detail, but are by no means limitative of the scope of the invention.

REFERENCE EXAMPLE

Preparation of Titanium Materials

Titanium material A: A mixture of 7.0% of titanium sulfate, 72.9% of anhydrous disodium hydrogenphosphate and 20.1% of water was heated at 100° C. to 120° C. with stirring until the water content became not more than 1.5% (about 2 hours). The powder obtained was designated as titanium material A. The content of titanium in the titanium material A was 1.68% by weight.

Titanium material B: A mixture of 11.0% of titanium sulfate, 68.6% of anhydrous disodium hydrogenphosphate and 20.4% of water was heated at 100° C. to 120° C. with stirring until the water content became not more than 1.5% (about 2 hours). The powder obtained was designated as titanium material B. The content of titanium in the titanium material B was 2.65% by weight.

EXAMPLES 1 & 2 AND COMPARATIVE EXAMPLES 1 TO 3

The titanium materials, anhydrous sodium pyrophosphate, anhydrous sodium tripolyphosphate, sodium carbonate and sodium bicarbonate were mixed together in the proportions shown in Table 1 and stirred well to give each condensed surface-conditioning agent. Baths were prepared by adding water to each surface-conditioning agent to a concentration of 0.1% (w/v) and stirring the resulting mixture well. The thus-prepared surface-conditioning agents were evaluated by the method mentioned below, and the results obtained are shown in Table 1.

(Evaluation Method)

Each surface-conditioning agent prepared as described above was exposed under the following treatment load every day immediately following the time of bath preparation.

(1) Aeration 200 liters of air/liter of a surface-conditioning agent (using an air pump).

(2) Metal treatment

Cold-rolled steel sheet (SPC) 0.42 $m^2$/liter of surface-conditioning agent (contact time: 20 seconds);

Galvanized steel sheet (SGAC) 0.42 $m^2$/liter of surface-conditioning agent (contact time: 20 seconds).

On the 10th day after bath preparation, zinc phosphating was performed and the chemical conversion coating on each steel sheet was observed and the durability of each surface-conditioning agent was evaluated.

(Zinc Phosphating)

Each cold-rolled steel sheet (SPC) (70×150×0.8 mm), degreased beforehand, was immersed in each surface-conditioning bath just after bath preparation and after 10 days of the above loading treatment at room temperature. After 1 minute of immersion, the bath liquid was drained off and the steel sheet was immediately subjected to the chemical conversion treatment by the dipping method using a zinc phosphating solution (Surfdyne SD2500, product of Nippon Paint) at 40° C. for 2 minutes, and then washed with water and dried.

In Table 1, the symbol ○ indicates that a uniform and dense zinc phosphate coating (crystal diameter of the zinc phosphate coating: 1 to 3 μm) was formed. The symbol Δindicates that a zinc phosphate coating (crystal diameter of the zinc phosphate coating: 3 μm or more) was formed with a hiding effect. The symbol x indicates that an insufficient hiding effect and/or yellow rust was observed and the crystal diameter of the zinc phosphate coating was not less than 3 μm.

TABLE 1

| | Example | | | Comparative Example | |
|---|---|---|---|---|---|
| | 1 | 2 | 3 | 1 | 2 |
| Formulation (%); | | | | | |
| Titanium material A | 40.0 | 26.6 | 40.0 | — | — |
| Titanium material B | — | — | — | 52.6 | 52.6 |
| Anhydrous disodium hydrogenphosphate | 15.0 | 43.4 | 30.0 | — | — |
| Anhydrous sodium pyrophosphate | — | — | — | 36.1 | — |
| Anhydrous sodium tripolyphosphate | 30.0 | 15.0 | 30.0 | — | 18.0 |
| Sodium carbonate | 15.0 | 10.0 | — | 11.3 | 10.0 |
| Sodium bicarbonate | — | 5.0 | — | — | 19.4 |
| Concentration (ppm) in 0.1% (w/v) surface-conditioning agent; | | | | | |
| Titanium ion | 6.7 | 4.5 | 6.7 | 13.9 | 13.9 |
| Phosphate ion | 277.6 | 450.9 | 444.9 | 303.1 | 303.1 |
| Condensed phosphate ion | 206.4 | 103.2 | 206.4 | 236.1 | 123.8 |
| Carbonate ion | 84.9 | 55.6 | — | 64.0 | 195.2 |
| Pyrophosphate ion/titanium ion | — | — | — | 17.0 | — |
| Tripolyphosphate ion/titanium ion | 30.8 | 22.9 | 30.8 | — | 8.9 |

TABLE 1-continued

| | Example | | | Comparative Example | |
|---|---|---|---|---|---|
| | 1 | 2 | 3 | 1 | 2 |
| pH of 0.1% surface-conditioning agent | 10.0 | 9.5 | 8.5 | 9.7 | 9.5 |
| Results cf chemical conversion treatment; | | | | | |
| Just after bath preparation | ○ | ○ | ○ | ○ | ○ |
| After 10 days | ○ | ○ | Δ | X | Δ |

We claim:

1. A highly durable surface-conditioning agent for use in a pretreatment step for a phosphate coating treatment of metallic materials, which is an aqueous solution comprising 1 to 50 ppm of titanium ion, 50 to 1,000 ppm of phosphate ion, 50 to 400 ppm of tripolyphosphate ion and 20 to 1,500 ppm of carbonate ion, with a tripolyphosphate ion/titanium ion weight ratio of 10 to 100, and having a pH of 8.5 to 10.0.

* * * * *